US006305114B1

(12) United States Patent
Saltz

(10) Patent No.: US 6,305,114 B1
(45) Date of Patent: Oct. 23, 2001

(54) SAFETY HAMMER FOR A FIREARM

(75) Inventor: Mitchell A. Saltz, Scottsdale, AZ (US)

(73) Assignee: Saf-T-Hammer Inc, Scottsdale, AZ (US)

( * ) Notice: Subject to any disclaimer, the term of this patent is extended or adjusted under 35 U.S.C. 154(b) by 0 days.

(21) Appl. No.: 09/267,145

(22) Filed: Mar. 11, 1999

Related U.S. Application Data

(63) Continuation-in-part of application No. 09/015,987, filed on Jan. 30, 1998, now abandoned.

(51) Int. Cl.[7] ..... F41A 17/26
(52) U.S. Cl. ..... 42/70.08; 42/66
(58) Field of Search ..... 42/70.08, 96, 66

(56) References Cited

U.S. PATENT DOCUMENTS

| | | | | |
|---|---|---|---|---|
| 246,817 | | 9/1881 | Proeschel | 42/66 |
| 982,152 | | 1/1911 | Marble | 42/69.01 |
| 2,527,957 | * | 10/1950 | Phillips | 42/70.08 |
| 3,624,947 | | 12/1971 | Worrall, Sr. | 42/66 |
| 3,762,089 | * | 10/1973 | Meyer, Jr. | 42/66 |
| 3,838,533 | | 10/1974 | Ruger | 42/66 |
| 4,833,811 | | 5/1989 | Wilkinson | 42/70.08 |
| 4,845,870 | | 7/1989 | Vernon | 42/70.08 |
| 5,208,406 | * | 5/1993 | Badali | 42/70.08 |
| 5,335,437 | | 8/1994 | Andersen | 42/70.08 |
| 5,622,160 | * | 4/1997 | Casa Salva | 124/76 |

* cited by examiner

*Primary Examiner*—Stephen M. Johnson
(74) *Attorney, Agent, or Firm*—The Halvorson Law Firm

(57) ABSTRACT

The present invention is an external hammer of the present invention is a structure or assembly having at least two-pieces: a hammer pivot and a hammer head. The hammer head of the present invention is removably attachable to the hammer pivot. In this manner, the hammer head may be removed from the hammer pivot, thereby making the weapon "safe". In the preferred embodiment the hammer head is attached to the hammer pivot by a puzzle-like structure. The hammer head has an incised puzzle-like mortise, while the hammer pivot has a projecting matching puzzle-like tenon. An additional feature found in the preferred embodiment is a hammer head securing structure. This structure, preferably a spring biased projection in the mortise that fits into a matching indent on the tenon, releasably secures and aligns the hammer head to the hammer pivot when the hammer head is attached to the hammer pivot. Finally, there is a removable hammer guard that is used in combination with the hammer of the present invention. The hammer guard is a yielding piece of material that, when in use, is placed between the hammer and firing chamber of a weapon. The hammer guard has a tapered lower portion and an upper portion with a cut-out that functions as a removable gunsight. The hammer guard allows the weapon to be dry-fired without damaging any parts.

7 Claims, 5 Drawing Sheets

SAFETY HAMMER FOR A FIREARM

This application is a continuation-in-part of application Ser. No. 09/015,987 filed on Jan. 30, 1998 now abandoned.

FIELD OF THE INVENTION

The present invention relates to the field of devices that enhance the safety of firearms. More specifically, the present invention is a new multi-piece hammer design for use with external hammer firearms.

BACKGROUND

Our society is experiencing an increase in criminal activity against individuals. This has spurred many individuals to keep firearms in their homes for personal protection. While a firearm, by itself, is not dangerous, when loaded there is a potential for accidental discharge. However, an unloaded weapon proves to be of little help when facing an attacker or intruder. Therefore, keeping home firearms loaded is the trend, despite the potential for accidents.

The increasing trend of keeping loaded firearms at home has probably resulted in an observed increase in the number of accidental weapon firings. These accidents are frequently caused by children playing with the weapon, or adults who are unaware of the loaded condition of the firearms. Thus, there is a need for devices that enhance the safety of loaded firearms and help reduce the frequency of accidental discharges.

The device of the present invention, which helps solve these and other problems, relates specifically to firearms with an external or exposed hammer. Typically, these hammers are pivotally mounted on the frame of the firearm and are designed to spring from a cocked position to a striking position, resulting in a cartridge contained in the chamber of the firearm to discharge. See FIGS. 1 and 2 for an example of a prior art external hammer firearm.

Firearms with exposed hammers are unique since the hammer may be manipulated or modified by the user while in both the cocked and the striking position. Although the present invention is applicable to all types of exposed firearm hammers, it is especially adapted to those hammers which are pivotally attached to the firearm frame and travel through an arc to carry or to strike a firing pin that impacts and discharges the cartridge. Hammers of this type vary widely in configuration, however, most are unitary in construction and have a front or striking face located above the pivot point of the attached hammer. Furthermore, these hammers are also characterized by a rearwardly projecting horn, usually knurled, that is adapted to be pulled rearwardly for cocking or releasing. A typical mechanism by which external hammers operate is that the external hammer has a sear notch located in a lower end that is engaged by a sear of the trigger 5 when the hammer is cocked. The hammer springs forward to strike the firing pin when the trigger 5 is pulled and the sear is disengaged from the sear notch.

Almost all firearms are provided with some form of safety mechanism which, when activated, is designed to prevent accidental or unwanted discharge of the firearm as it is carried or handled. These safety mechanisms may comprise a safety notch in the hammer that is engaged by the sear (or some equivalent element) of the trigger 5 when the hammer is in its safe position (out of contact with the firing pin), or it may comprise a separate member that can be placed between the hammer and the frame to prevent the hammer from striking the firing pin.

Examination of the prior art reveals several interesting hammer mechanisms that have been created to enhance safety. One example is U.S. Pat. No. 5,335,437 issued to Andersen. In this patent, the disclosed hammer has a firing pin striking surface that may be manually recessed. With the firing pin striking surface in a recessed position, movement of the hammer between the cocked position and the strike position does not cause the firing pin to be impacted, thereby preventing discharge of the firearm.

Another example is U.S. Pat. No. 3,624,947 issued to Worrall, Sr. The hammer disclosed in this patent includes a two-position rotating wheel. In one position, the firing position, the wheel has a recessed flat section that allows the hammer to reach its full forward position and to strike the firing pin. In the second position, the "safe" position, the wheel is not recessed and does not allow the hammer to reach its full forward position, thereby preventing the discharge of a cartridge contained in the chamber.

Yet another example is U.S. Pat. No. 3,838,533 issued to Ruger. This patent discloses another two-position rotating safety. When in the "safe" position, the "wheel" of the Ruger patent provides a depression instead of a firing surface. Thus the firing pin is not impacted. However, when in the firing position, the "wheel" provides a non-recessed firing pin striking surface, thereby allowing contained cartridges to be discharged.

While the above devices address some of the problems of firearm safety, it is evident that there is a present and a continuing need for further developments in the field of firearm safety devices.

SUMMARY OF THE INVENTION

It is an object of the present invention to provide a hammer for use with firearms that may be used as an additional safety mechanism preventing unwanted discharges.

It is another object of the present invention to provide a firearm hammer head that is removable such that when the hammer head is removed, the firearm is incapable of discharge.

It is a further object of the present invention to provide an external hammer head that may be replaceably removed from a hammer pivot, removal of the hammer head prevents the firearm from discharging and replacement of the hammer head re-enables the firearm to discharge.

It is yet another object of the present invention to provide a removable firearm hammer that includes a securing structure that secures the hammer head to the hammer pivot when the two pieces are assembled together.

It is yet a further object of the present invention to provide a removable hammer head securing device that comprises a recessable projection and detent pair.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF PREFERRED EMBODIMENTS

Figure 1:
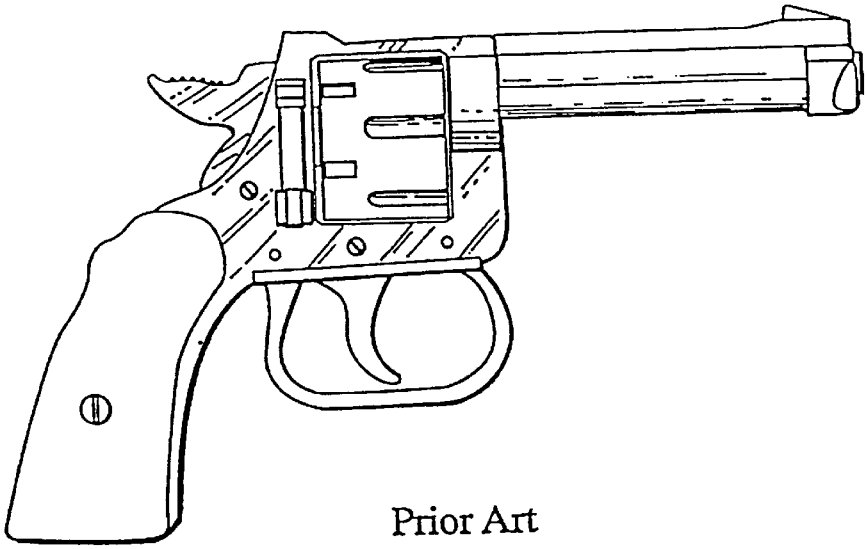
FIG. 1 and FIG. 2 are two views of a prior art revolver clearly illustrating the revolver hammer in both the rest and cocked positions.
Figure 2:
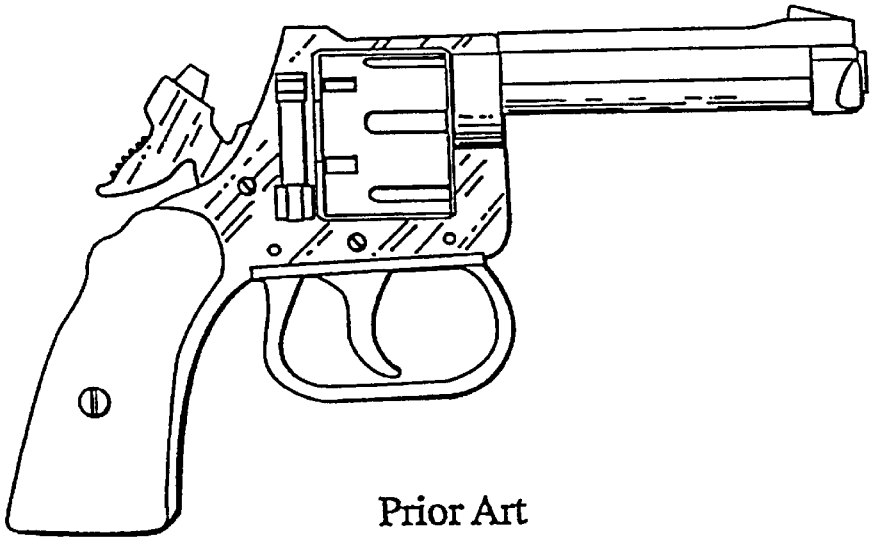
Figure 3:
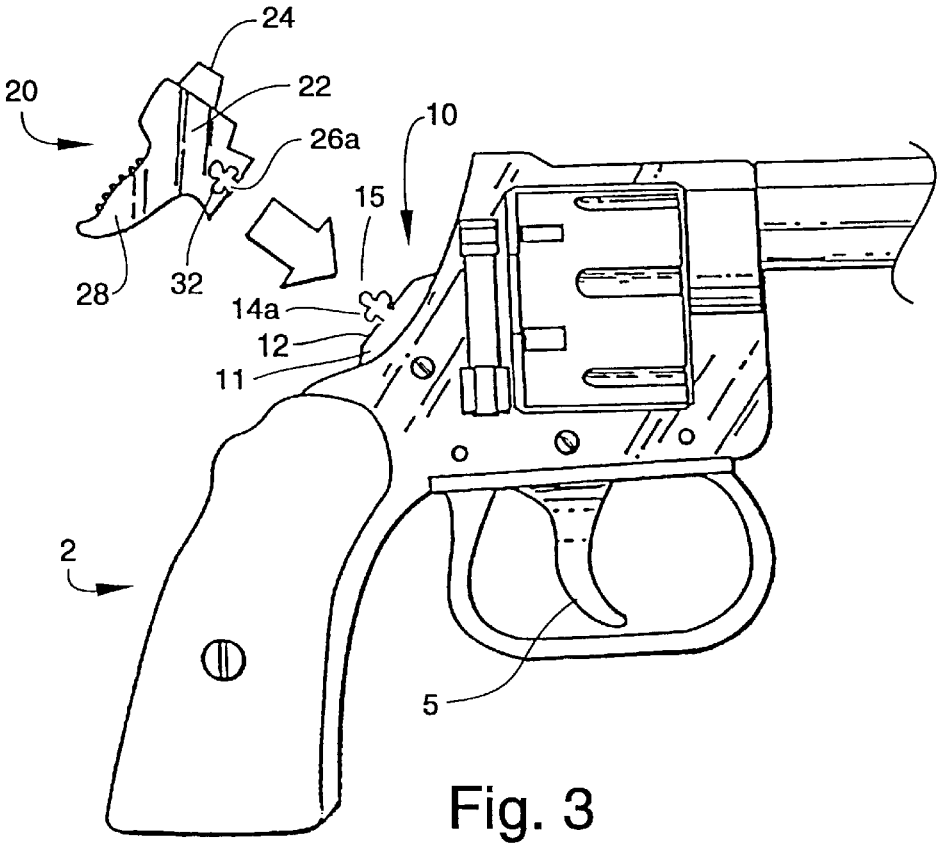
FIG. 3 shows the removable hammer of the present invention in its removed configuration.
Figure 4:
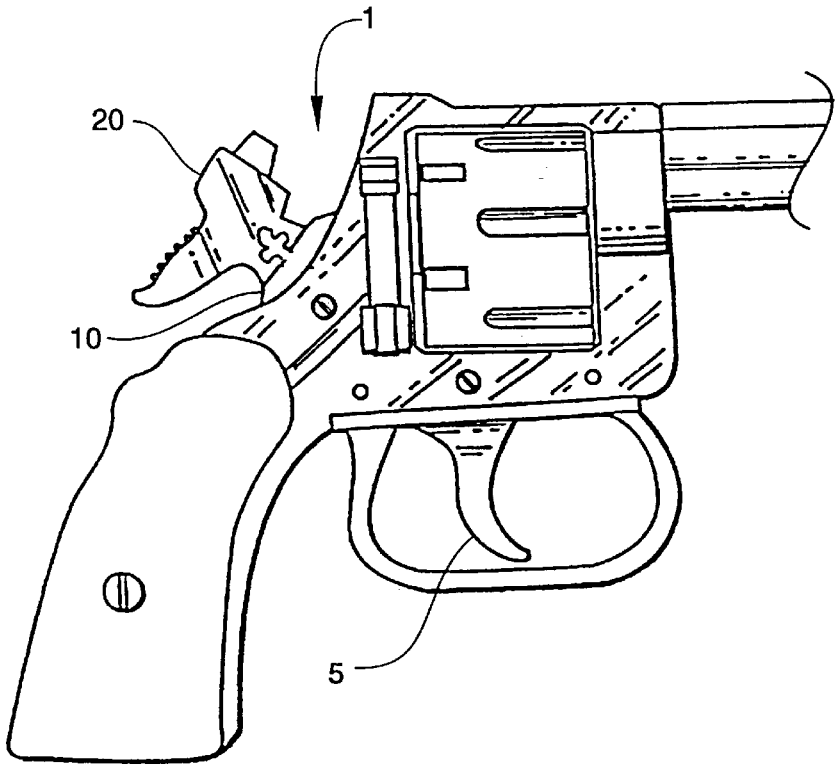
FIG. 4 shows the removable hammer of the present invention in its attached configuration.
Figure 5:
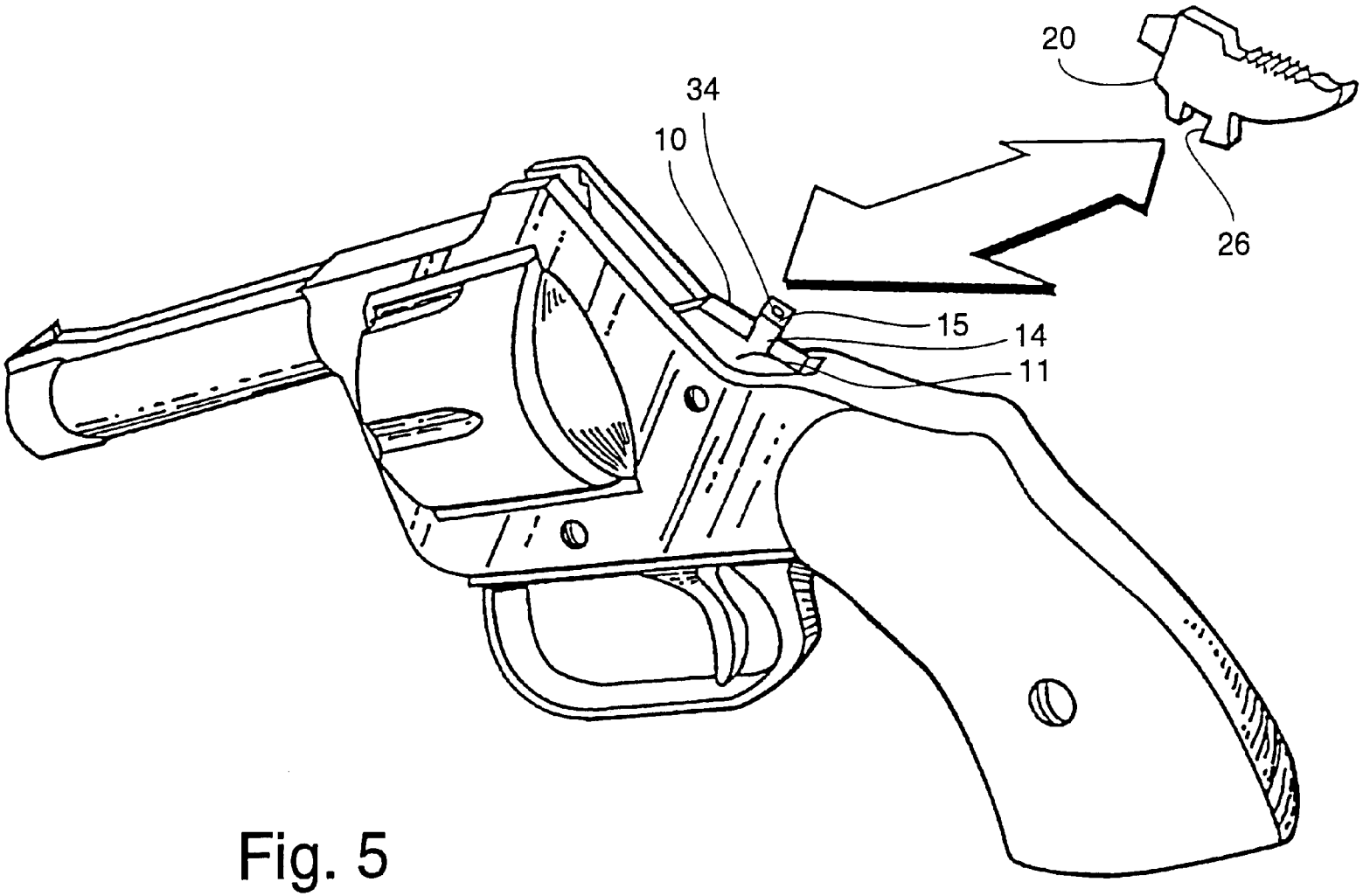
FIG. 5 illustrates how the removable hammer according to the present invention is attached to the hammer pivot by a lateral sliding motion.

The present invention is an external firearm hammer 1 that is useful for aiding in the safe handling and storage of weapons, especially loaded weapons. Moreover, the device of the present invention is useful in reducing the number of unwanted or accidental weapon discharges that occur. These and other uses will be more fully appreciated by examination of the following description of the present invention.

The external hammer 1 of the present invention is a device having at least two-pieces: a hammer pivot 10 and a hammer head 20. It is critical to the present invention that the hammer head 20 be removably attachable to the hammer pivot 10. In this manner, the hammer head 20 may be removed from the hammer pivot 10, thereby making the weapon 2 "safe". Thus, if the firearm trigger 5 is accidentally or intentionally actuated, the weapon 2 will be incapable of discharging.

The preferred attachment structure according to the present invention is a dovetail-like structure. The hammer head 20 has a body 22 with a firing pin striking surface 24 (or alternately, an attached firing pin) and contains a dovetail mortise 26. Additionally, the hammer head 20 may further include a ridged or knurled thumb projection 28, used to cock or reset the trigger 5 when the hammer head 20 is attached to the hammer pivot 10. The hammer pivot 10, which is pivotally attachable to the firearm, or weapon, 2 according to ordinary and well known means, has a body 11 with a first surface 12 having a projecting dovetail tenon 14. This dovetail tenon 14 is adapted to snuggly or closely fit in to the matching dovetail mortise 26 located in the hammer head 20. Thus, the hammer head 20 may be removed, or reattached, by merely matching the tenon 14 with the mortise 26 and sliding the hammer head 20 laterally onto the hammer pivot 10. Alternate attachment structures, which function to releasably attach the hammer head 20 to the hammer pivot 10, are possible and are considered to be encompassed by the present invention and to fully fall within the scope of the claims herein.

Likewise, though not as preferred, this same attachment structure may be used with an exposed trigger thereby making the trigger 5 itself removable. In this form, once the weapon 2 has been cocked, the trigger 5 is removed. This prevents the weapon 2 from being fired by accidental actuation of the trigger 5. Then, when use of the weapon 2 is desired, the trigger 5 is reattached in a manner similar to the reattachment of the hammer head 20 discussed above.

An additional feature found in the preferred embodiment is a hammer head securing structure 30. This structure 30 releasably secures the hammer head 20 to the hammer pivot 10 when the hammer head 20 is attached to the hammer pivot 10.

Figure 6:
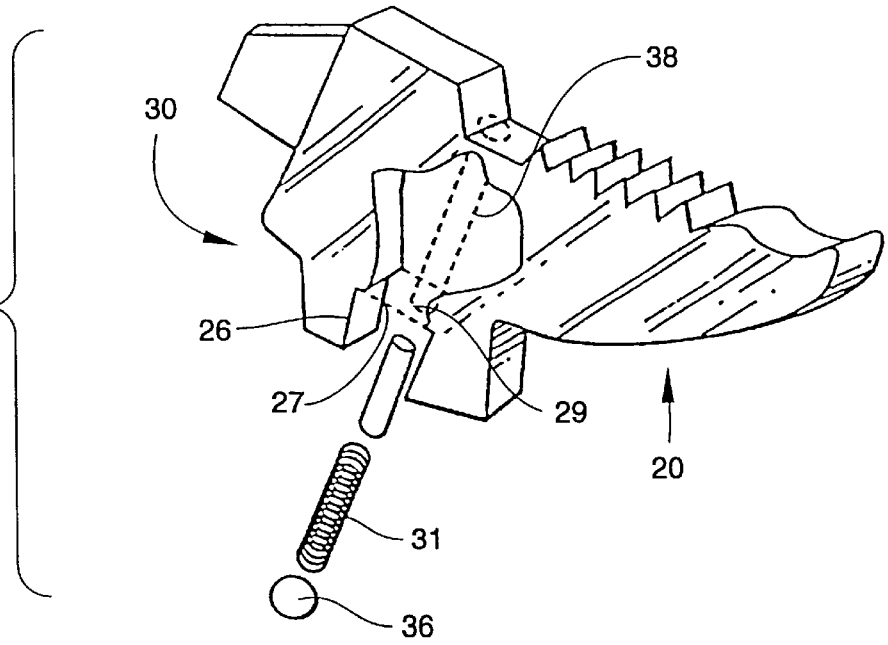
FIG. 6 shows one embodiment of the spring biased retaining mechanism according to the present invention.
Figure 7:
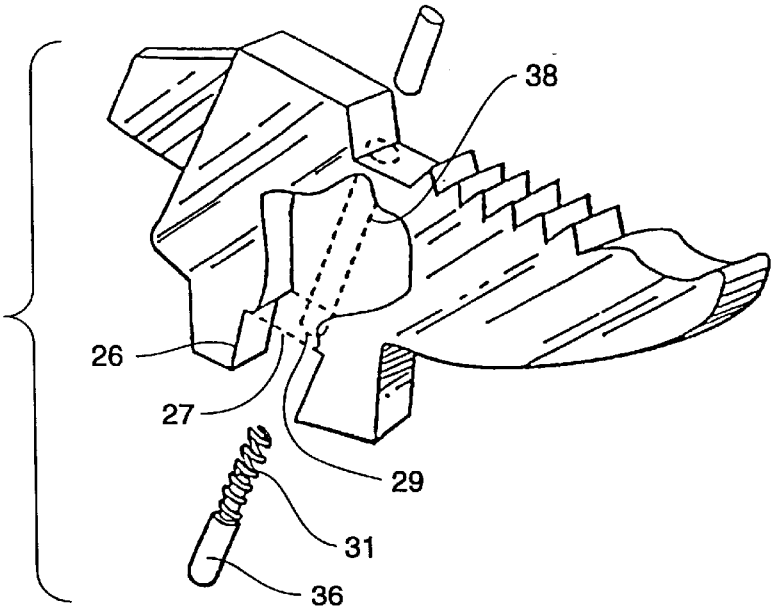
FIG. 7 shows a second embodiment of the spring biased retaining mechanism according to the present invention.
Figure 8:
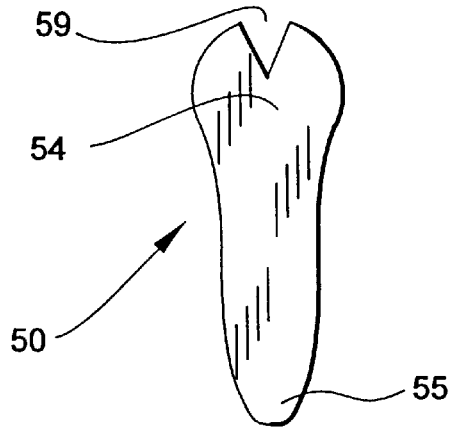
FIG. 8 shows the hammer guard according to the present invention.
Figure 9:
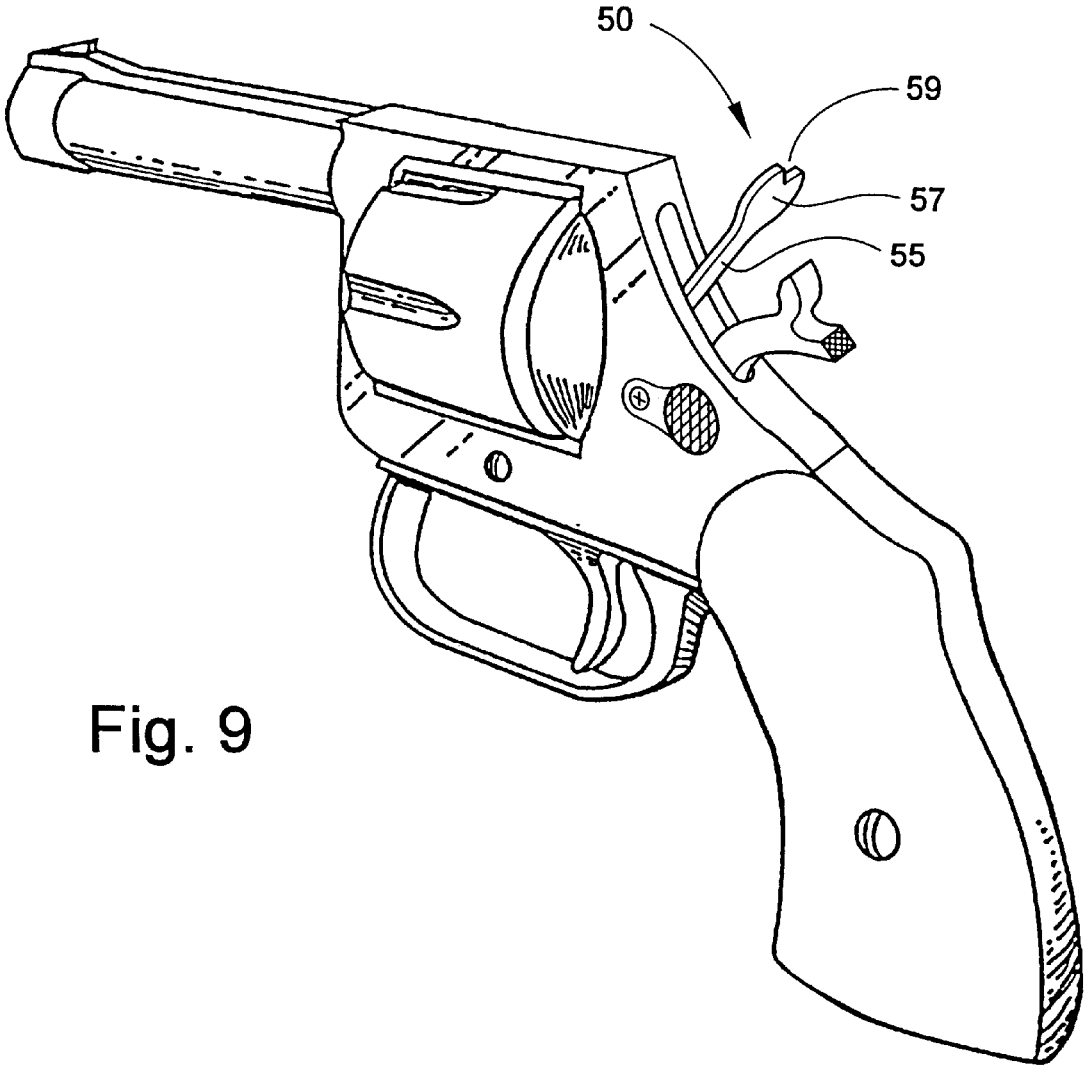
FIG. 9 shows the hammer guard used with a firearm according to the present invention.

The preferred hammer securing structure 30 according to the present invention is a spring biased 31 movable projection 32 that fits in a matching depression or hole 34. Preferred forms of this type of structure 30, illustrated in FIGS. 6 and 7. A ball, or rod, 36 is contained within a chamber 38 located within the hammer head 20. The chamber 38 intersects a top surface 27 of the mortise 26 of the hammer head 20 to form a small aperture 29. The spring biasing 31 urges the ball, or rod, 36 forward such that it partially projects through the small aperture 29 in the top surface 27 of the mortise 26 of the hammer head 20. Therefore, the projecting portion is capable of being forced back into the chamber 38 by using a force sufficient to overcome the spring biasing.

The projecting portion of the ball, or rod, 36 is adapted to be received by a matching indentation, or hole, 34 located in a top surface 15 of the tenon 14 of the hammer pivot 10. Thus, when the hammer head 20 is initially slid onto the hammer pivot 10, the top surface 15 of the tenon 14 pushes the ball, or rod, back into the chamber 38. Then, when the dovetail is in the correct position, such as when the indentation, or hole, 34 is coaxial with the chamber 38, the spring biasing 31 will force the projecting portion of the ball, or rod, 36 into the indentation, or hole 34. The spring biasing 31 determines the amount of force necessary to remove, or attach, the hammer head 20.

The securing structure 30 is also useful to maintain the alignment of the hammer head 20 relative to the firing pin or cartridge. Thus, when secured, the hammer head 20 will not slip or move laterally out of alignment.

Finally, when the hammer pivot 10 has a hole 29 in the top surface 15 of the tenon 14, this hole 15 may be used to uncock the hammer pivot 10. It has been found that it is difficult to attach the hammer head 20 if the trigger 5 has been actuated and the hammer pivot 10 is in the "strike" position. Therefore, if the hammer head 20 has been removed and the trigger 5 actuated, the hammer pivot 10 will have to be uncocked to reattach the hammer head 20. This is accomplished by inserting a pin or rod into the hole 34 (preferably, the pin or rod will have an attached handle) and pulling backward, toward the handle of the firearm 2. The hammer head 20 may them be reattached and the firearm 2 ready for use. Other forms or methods for uncocking the hammer pivot 10 are considered to fall within the scope of the present invention.

In an alternate embodiment, the attachment structure according to the present invention is a matching freeform insert and cut-out, or puzzle-like, structure. The hammer head 20 has a body 22 with a firing pin striking surface 24 (or alternately, an attached firing pin) and includes a ridged or knurled thumb projection 28, used to cock or reset the trigger 5 when the hammer head 20 is attached to the hammer pivot 10. The bottom portion of the hammer head 20 contains a curved cut-out **26*a* that receives a complementary shape 14*a* that projects from the top of the hammer pivot 10. The shape of the curved cut-out 26*a* and matching complementary piece 14*a* should have at least one projection or indention (the complementary shapes would be an indention or projection on the matching complementary piece 14). While one projection or indention works for the present invention, more than one would be preferable for structural strength reasons. Additionally, if there is a two-fold axial symmetry to the shape, the hammer head 20 could be reversed and attached to the hammer pivot 10** in a backward position, thereby maintaining the piece with the weapon and still preventing any accidental firing. It is critical for this application that the knurled thumb projection 28 should not be shaped and positioned to inadvertently act as a secondary firing pin.

The hammer pivot 10, which is pivotally attachable to the firearm, or weapon, 2 according to ordinary and well known means, has a body 11 with a first surface 12 having the complementary shape 14*a*. This complementary shape 14*a* is adapted to snuggly or closely fit in to the matching curved cut-out 26*a* located in the hammer head 20. Thus, the hammer head 20 may be removed, or reattached, by merely matching the complementary shape 14*a* with the curved cut-out 26*a* and sliding the hammer head 20 laterally onto the hammer pivot 10. Alternate attachment structures and shapes, which function to releasably attach the hammer head 20 to the hammer pivot 10, are possible and are considered to be encompassed by the present invention and to fully fall within the scope of the claims herein.

Finally, the present invention includes a hammer guard 50 that is designed to be used either with or without the above described two-part hammer 1, preferably with. The hammer guard 50 is preferably a single piece, yielding polymeric insert that is placed, when used, between the hammer 1 and firing pin of a gun. The yielding nature of the insert allows the weapon to be dry fired without mechanical damage to any parts of the weapon. Additionally, it is preferred that the hammer guard be brightly colored. The bright coloration assures that the eye is drawn to the insert, alerting the user that the insert is in place.

Structurally, the hammer guard 50 is substantially flat and has a tapered lower portion 55 that is shaped to allow snug fit into the space a hammer 1 travels as it is being fired. Further, there is an upper portion 57 that includes a cut-out notch 59 or gunsight. Thus, when the hammer guard 50 is in place, the notch 59 effectively becomes a removable rear gunsight that allows the user to practice aiming the weapon while dry-firing it.

As discussed briefly above, it is optimal to use the hammer guard 50 in conjunction with the two part hammer 1 of the present invention. However, due to its unique nature, the hammer guard 50 may also be used with other weapons with external hammers.

While these descriptions directly describe the above embodiments, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A safety device for a firearm comprising at least three pieces, a hammer pivot, which is rotationally secured to and projects from a firearm body and an external hammer head, whereby the external hammer head is adapted to be removably attachable to the hammer pivot, in combination with a resilient hammer guard that is sized to fit between the external hammer and firing chamber of a weapon.

2. The safety device according to claim 1 wherein the external hammer head further includes a puzzle-like mortise and the hammer pivot further includes a matching puzzle-like tenon, whereby the external hammer head is removably attachable to the hammer pivot by a puzzle-like piece formed by inserting the tenon into the mortise.

3. The safety device according to claim 2 wherein the external hammer head is releasably securable to the hammer pivot by a securing structure.

4. A safety device for a firearm comprising at least three pieces, a hammer pivot, which projects from a firearm body and an external hammer head, whereby the external hammer head is adapted to be removably attachable to the hammer pivot, in combination with a resilient hammer guard that is sized to fit between the external hammer and firing chamber of a weapon, wherein the external hammer head further includes a puzzle-like mortise and the hammer pivot further includes a matching puzzle-like tenon, whereby the external hammer head is removably attachable to the hammer pivot by a puzzle-like piece formed by inserting the tenon into the mortise, wherein the external hammer head is releasably securable to the hammer pivot by a securing structure, and wherein the securing structure further is a spring biased ball located in a chamber contained within the external hammer head, the chamber further intersects a top surface of the mortise to provide a small aperture through which a portion of the ball is capable of projecting, and a depression located in a top surface of the tenon of the hammer pivot, whereby when the external hammer head is attached to the hammer pivot and the depression is coaxial with the chamber, the projection portion of the ball fits into the depression inhibiting removal of the external hammer head.

5. A safety device for a firearm comprising at least three pieces, a hammer pivot, which projects from a firearm body and an external hammer head, whereby the external hammer head is adapted to be removably attachable to the hammer pivot, in combination with a resilient hammer guard that is sized to fit between the external hammer and firing chamber of a weapon, wherein the external hammer head further includes a puzzle-like mortise and the hammer pivot further includes a matching puzzle-like tenon, whereby the external hammer head is removably attachable to the hammer pivot by a puzzle-like piece formed by inserting the tenon into the mortise, wherein the external hammer head is releasably securable to the hammer pivot by a securing structure, and wherein the securing structure further is a spring biased rod located in a chamber contained within the external hammer head, the chamber further intersects a top surface of the mortise to provide a small aperture through which a portion of the rod is capable of projecting, and a depression located in a top surface of the tenon of the hammer pivot, whereby when the external hammer head is attached to the hammer pivot and the depression is coaxial with the chamber the projecting portion of the rod fits into the depression inhibiting removal of the external hammer head.

6. A safety device for a firearm comprising at least three pieces, a hammer pivot, which projects from a firearm body and an external hammer head, whereby the external hammer head is adapted to be removably attachable to the hammer pivot, in combination with a resilient hammer guard that is sized to fit between the external hammer and firing chamber of a weapon, wherein the external hammer head further includes a puzzle-like mortise and the hammer pivot further includes a matching puzzle-like tenon, whereby the external hammer head is removably attachable to the hammer pivot by a puzzle-like piece formed by inserting the tenon into the mortise, wherein the external hammer head is releasably securable to the hammer pivot by a securing structure, and wherein the securing structure further is a spring biased ball located in a chamber contained within the external hammer head, the chamber further intersects a top surface of the mortise to provide a small aperture through which a portion of the ball is capable of projecting, and a hole located in a top surface of the tenon of the hammer pivot, whereby when the external hammer head is attached to the hammer pivot and the depression is coaxial with the chamber, the projecting portion of the ball fits into the hole inhibiting removal of the external hammer head.

7. A safety device for a firearm comprising at least three pieces, a hammer pivot, which projects from a firearm body and an external hammer head, whereby the external hammer head is adapted to be removably attachable to the hammer pivot, in combination with a resilient hammer guard that is sized to fit between the external hammer and firing chamber of a weapon, wherein the external hammer head further includes a puzzle-like mortise and the hammer pivot further includes a matching puzzle-like tenon, whereby the external hammer head is removably attachable to the hammer pivot by a puzzle-like piece formed by inserting the tenon into the mortise, wherein the external hammer head is releasably securable to the hammer pivot by a securing structure, and wherein the securing structure further is a spring biased rod located in a chamber contained within the external hammer head, the chamber further intersects a top surface of the mortise to provide a small aperture through which a portion of the rod is capable of projecting, and a hole located in a top surface of the tenon of the hammer pivot, whereby when the external hammer head is attached to the hammer pivot and the depression is coaxial with the chamber, the projecting portion of the rod fits into the hole inhibiting removal of the external hammer head.

* * * * *